US007028517B2

(12) United States Patent
Divito

(10) Patent No.: US 7,028,517 B2
(45) Date of Patent: Apr. 18, 2006

(54) CYLINDER LOCK WITH PROGRAMMABLE KEYWAY

(75) Inventor: Thomas J. Divito, Southington, CT (US)

(73) Assignee: Kaba High Security Locks Corporation, Southington, CT (US)

( * ) Notice: Subject to any disclaimer, the term of this patent is extended or adjusted under 35 U.S.C. 154(b) by 151 days.

(21) Appl. No.: 10/616,591

(22) Filed: Jul. 9, 2003

(65) Prior Publication Data

US 2005/0005658 A1 Jan. 13, 2005

(51) Int. Cl.
*E05B 27/00* (2006.01)

(52) U.S. Cl. ..... 70/493; 70/356; 70/392

(58) Field of Classification Search ..... 70/493, 70/358, 356, 357, 490, 491, 492, 378, 352, 70/367, 392, 389, 495

See application file for complete search history.

(56) References Cited

U.S. PATENT DOCUMENTS

| | | | | | |
|---|---|---|---|---|---|
| 396,628 | A | * | 1/1889 | Hoevenbergh | 70/337 |
| 3,167,943 | A | * | 2/1965 | Schreiber et al. | 70/358 |
| 3,742,744 | A | * | 7/1973 | Lumme | 70/358 |
| 4,166,025 | A | * | 8/1979 | Nametkin et al. | 208/126 |
| 4,193,277 | A | * | 3/1980 | Lo | 70/358 |
| 4,325,242 | A | | 4/1982 | Tietz | |
| 4,398,404 | A | * | 8/1983 | Wake | 70/276 |
| 4,580,425 | A | * | 4/1986 | Smith | 70/421 |
| 4,612,787 | A | * | 9/1986 | Prunbauer et al. | 70/358 |
| 4,627,251 | A | * | 12/1986 | Bhate | 70/276 |
| 5,079,936 | A | * | 1/1992 | Stefanek | 70/358 |
| 5,819,566 | A | | 10/1998 | Eden, Jr. | |
| 5,819,567 | A | | 10/1998 | Eden, Jr. | |
| 5,970,761 | A | | 10/1999 | Eden, Jr. | |
| 6,058,750 | A | * | 5/2000 | Li | 70/358 |
| 6,519,988 | B1 | | 2/2003 | Wu | |
| 6,748,777 | B1 | * | 6/2004 | Livingston | 70/369 |
| 6,755,062 | B1 | * | 6/2004 | Price | 70/493 |

FOREIGN PATENT DOCUMENTS

DE 40 35 934 A 1 6/1991

* cited by examiner

*Primary Examiner*—John B. Walsh
(74) *Attorney, Agent, or Firm*—Alix, Yale & Ristas, LLP

(57) ABSTRACT

A core having a plurality of pin bores penetrating from the core surface to the keyway, and a plurality of activator pins and filler pins, such that the installer can locate one or more activator pins in any of the pin bores, and one or more filler pins in any of the remaining bores, to thereby define a code to be provided in the respective flank or flanks of an authorized key. Preferably at least three bores are provided on at least one side of the core; especially preferred are five pin bores on either side of the core fitted with a pattern of activator pins and filler pins, whereas a sixth pin bore on each side, closest to the back end of the core, is fitted with a blocking pin. In various embodiments, the present invention is directed to a programmable cylinder lock system, a programmable core for a cylinder lock, a core kit by which the installer can program the core in the field, and a novel key adapted to be used with the programmable core.

19 Claims, 7 Drawing Sheets

CYLINDER LOCK WITH PROGRAMMABLE KEYWAY

BACKGROUND OF THE INVENTION

The present invention relates to cylinder locks, and more particularly, to programmable cylinder locks.

The development of security locks has focused for a number of years on not only enhancing the intricacy of the primary coding between the key and the lock mechanism, but furthermore, in developing secondary coding which must also be satisfied in order for the lock to operate properly. Moreover, in some instances a further security feature is provided, according to which an unauthorized key is trapped during an attempt to operate the lock.

Although these prior techniques are effective for their intended purpose of enhancing the security of the lock, the enhanced security features typically involve somewhat intricate machining of components or complex placement of components during assembly of the lock. Furthermore, the particular coding necessary for authorized operation of the lock must with typical prior art techniques, be established in the lock by the lock manufacturer or distributor. This complexity increases the cost of the lock system, and often limits the flexibility and timeliness of the installation and/or replacement of high security locks.

SUMMARY OF THE INVENTION

It is accordingly an object of the present invention, to provide a programmable cylinder lock system which has enhanced security and preferably key trapping features.

It is a particular object of the invention that the core portion of the cylinder lock be programmable in the field, by a locksmith or an installer.

It is a further object of the invention that the programmability and enhanced security be implemented in a relatively simple yet cleaver manner, that does not require intricate machining or complex assembly by either the lock manufacturer or the installer.

It is a further object to provide a key blank having an enhanced security coding that can readily be manufactured, but which if imitated without authority, will not only fail to operate, but will be trapped.

According to a general aspect of the invention, a core has a plurality of pin bores penetrating from the core surface to the keyway, and a plurality of activator pins and filler pins, such that the installer can locate one or more activator pins in any of the pin bores, and one or more filler pins in any of the remaining bores, to thereby define a code to be provided in the respective flank or flanks of an authorized key. Preferably at least three bores are provided on at least one side of the core, but as a practical matter, four or more pin bores provided on each side of the core offers sufficient variations to thwart all but the most sophisticated attempts at gaining unauthorized entry. Preferably, five pin bores on either side of the core are fitted with a pattern of activator pins and filler pins, whereas a sixth pin bore on each side, closest to the back end of the core, is fitted with a blocking pin.

In various embodiments, the present invention is directed to a programmable cylinder lock system, a programmable core for a cylinder lock, a core kit by which the installer can program the core in the field, and a novel key adapted to be used with the programmable core.

The programmable cylinder lock comprises a substantially cylindrical core having front and back ends and a keyway having a key entry at the core front end and sidewalls shaped to closely receive a key blade having opposed top and bottom edges and opposed left and right flanks. A substantially cylindrical shell has a longitudinal bore closely coaxially surrounding the outer surface of the core. The core has a neutral position within the shell such that the keyway top and bottom are at 0 and 180 degree positions, respectively, relative to the axis when viewed from the keyway entry and the core can rotate within the shell bore when a properly coded key is fully inserted in the keyway. A plurality of tumbler bores are located in the shell and penetrate the shell bore at a 0 degree angle relative to the neutral position of the core. A respective plurality of tumblers are located in the tumbler bores and biased toward the shell bore so as to contact the core. A plurality of pin bores extend a uniform distance from the outer surface of the core to penetration of at least one keyway sidewall at intermediate angle to the axis. An activator pin is situated in at least one of the pin bores, having a length substantially equal to the uniform distance and a shape for interacting with the pin bore such that the pin can freely enter into the keyway. A filler pin is situated in at least one of the pin bores, having a length no greater than the uniform distance and a shape for interacting with the pin bore such that the pin cannot enter into the keyway.

The programmable core for a cylinder lock comprises a substantially cylindrical core having an outer surface, front and back ends and a keyway having a key entry at the core front end and extending along the core longitudinal axis toward a core back end. The keyway has a top wall and an opposed open bottom and opposed left and right sidewalls shaped to closely receive a key blade having opposed top and bottom edges and opposed left and right flanks, such that the keyway top and bottom are at 0 and 180 degree positions, respectively, relative to the axis when viewed from the keyway entry. The outer surface of the core has at least three left side pin bores extending a uniform distance from the outer surface of the core to penetration of the keyway left sidewall, at a first intermediate angle to the axis, and at least three right side pin bores extending a uniform distance from the outer surface of the core to penetration of the keyway right sidewall, at a second intermediate angle to the axis.

The programmable core kit for a cylinder lock comprises the foregoing programmable core in combination with a plurality of activator pins insertable into any of the pin bores, each having a head, a stem, and an overall length substantially equal to the uniform distance, for interacting with the pin bore such that the stem can freely enter into the keyway with the head recessed from the core outer surface. A plurality of filler pins are insertable into any of the pin bores, each having a head, a stem, and an overall length no greater than the uniform distance, for interacting with the pin bore such that the head is substantially flush with the core outer surface and the stem cannot enter into the keyway.

The key according to the invention comprises a bonnet for grasping with fingers and a blade extending from the bonnet and having top and bottom edges and left and right flanks with opposed planar surfaces defining a key nominal thickness corresponding to the keyway width, each of the flanks having a recessed longitudinal and channel, each channel having at least one raised node at a respective planar surface.

BRIEF DESCRIPTION OF THE DRAWINGS

The preferred embodiment of the invention will be described in greater detail with reference to the accompanying drawings, in which.

DESCRIPTION OF THE PREFERRED EMBODIMENT

The present invention is an improvement to, and is based on, a conventional cylinder lock having a substantially cylindrical core for rotation within a substantially hollow cylindrical shell when a properly coded key is fully inserted within a coded keyway in the core. A conventional cylinder will not be further described herein, because one of ordinary skill in the art is very familiar with the way in which the bits on the top edge of a key blade cooperate with tumblers arranged between the shell and core to block the rotational shear line between the shell and the core when no key is present, and to clear the shear line when a properly bitted key is present.

The present invention provides an additional level of coding associated with the flank of the blade, and the portions of the core and shell which are not normally involved with the conventional cooperation of the key bits with the associated tumblers.

Figure 1:
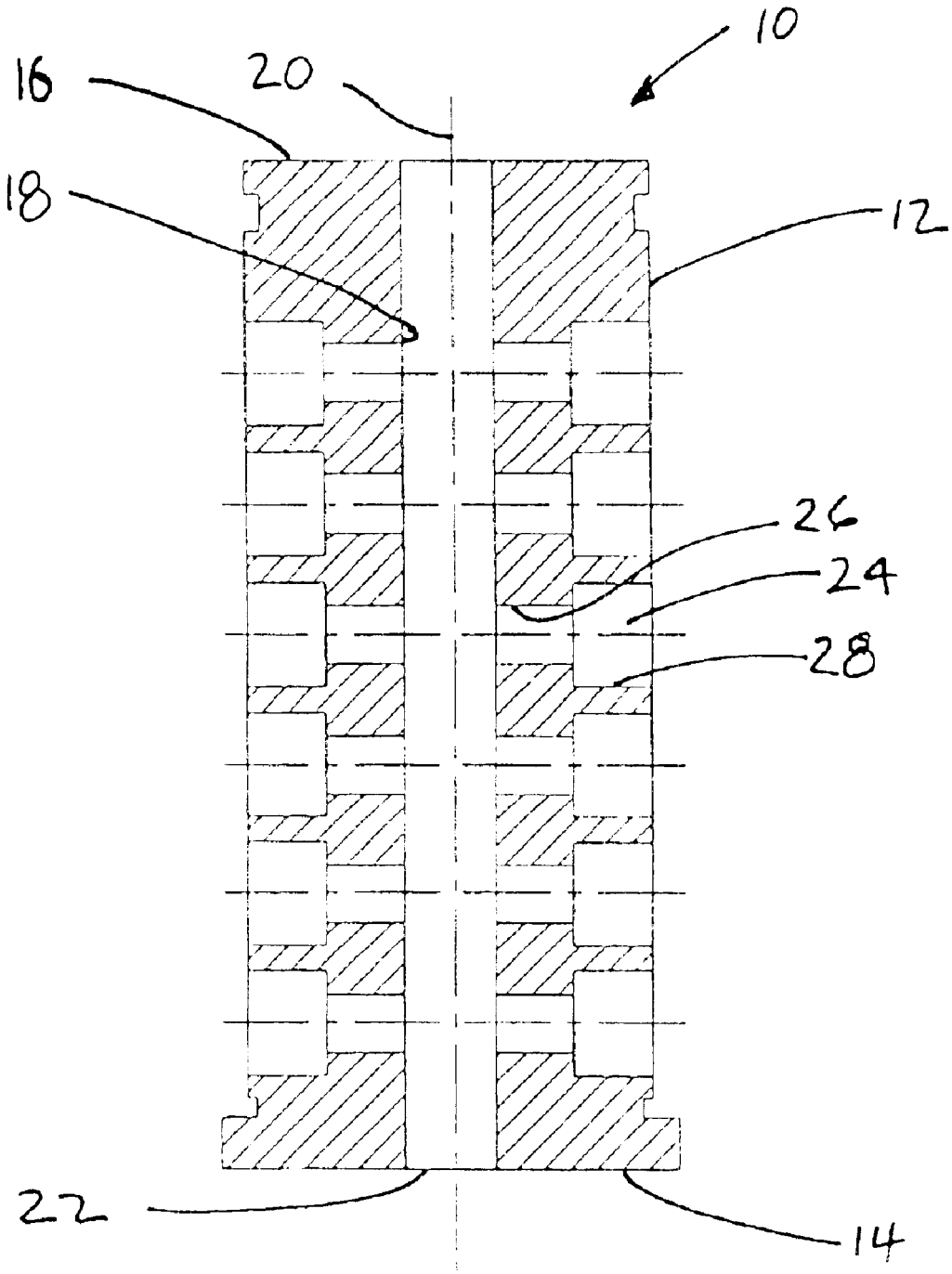
FIG. 1 is a longitudinal section view through a cylindrical core having a plurality of transversely oriented pin bores for receiving a variety of pins of different character whereby the core can be programmed in the field.
Figure 2:
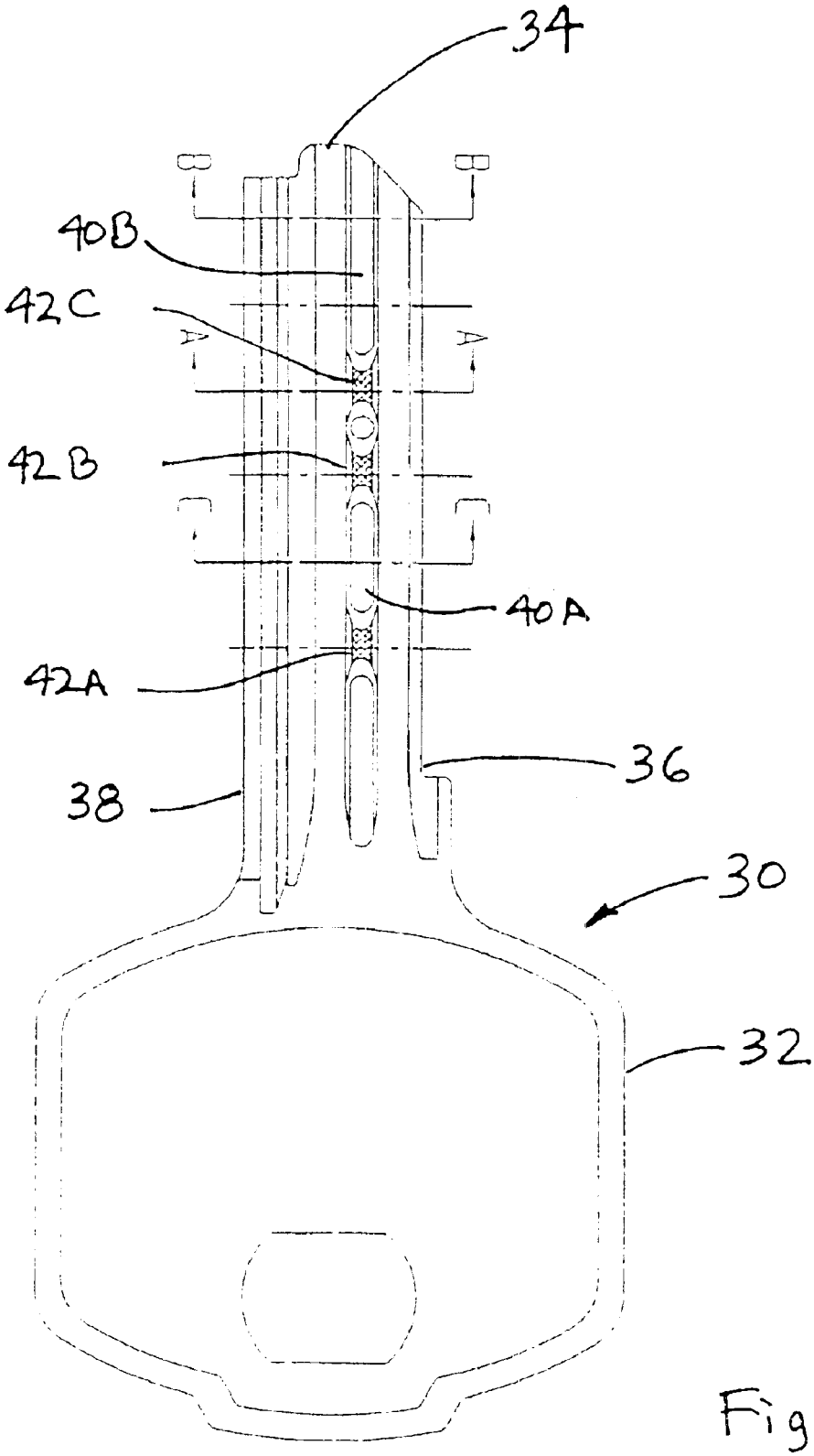
FIG. 2 is a plan view of a key adapted to be used with the programmable core according to the invention.
Figure 3:
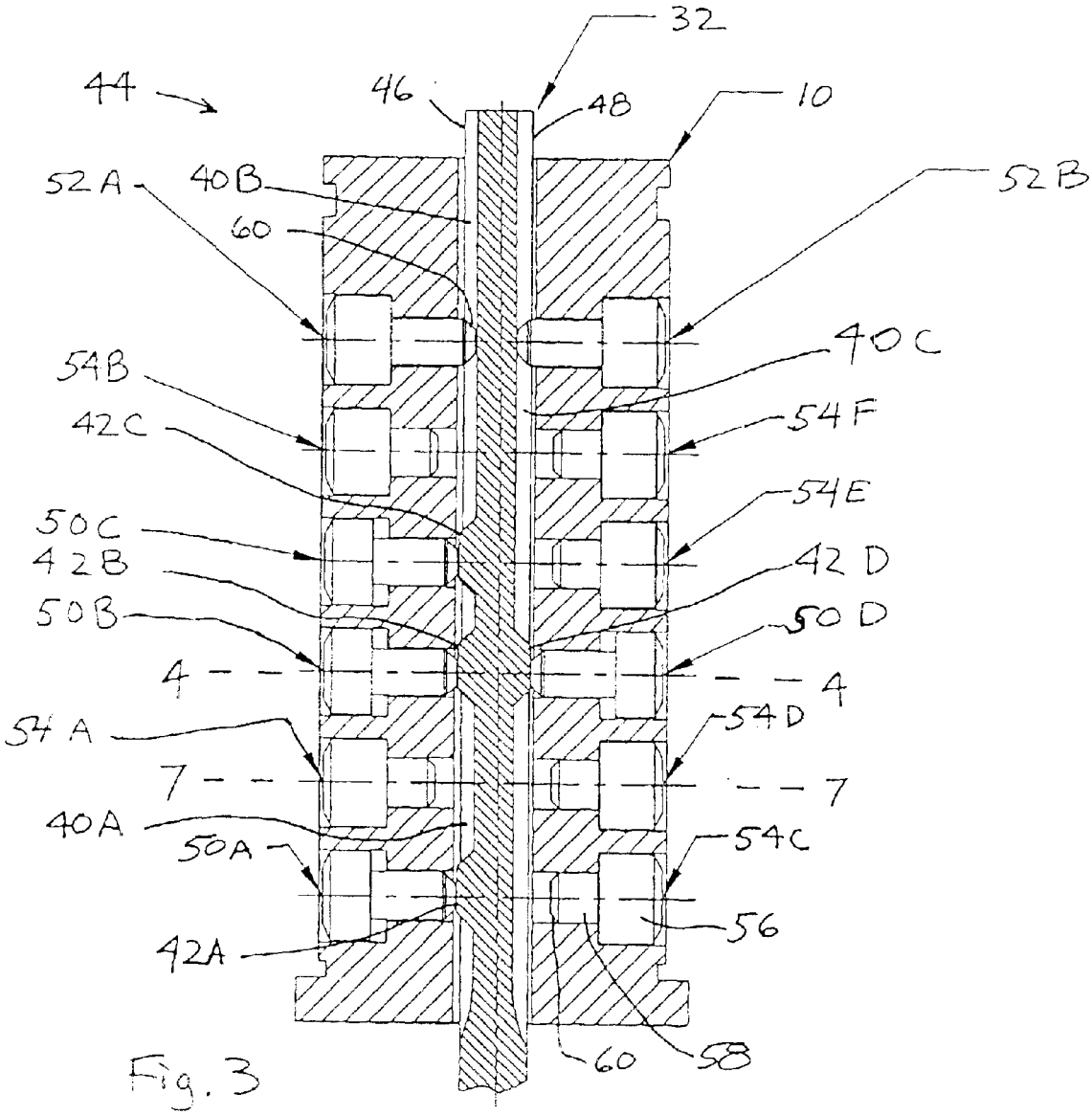
FIG. 3 is a section view similar to FIG. 1, but with a particular pattern of pins defining a security code, and an authorized key coded for compatibility with the coded core.

As shown in FIGS. 1–3, a programmable core 10 has a substantially cylindrical body 12 with a front end 14, a back end 16, and a keyway 18 centered on the core axis 20, with a keyway entry 22 at the front end. The plurality of pin bores 24 extend from the outer surface of the core transversely to the axis a uniform distance to the keyway. Each pin bore preferably has an inner through bore portion 26 and an outer, enlarged counter bore portion 28.

A key 30 having a bonnet portion 32 for grasping between the fingers, and a blade portion 34 extending from the bonnet, has a top edge 36, a bottom edge 38 and left and right flanks 46, 48 defining a thickness corresponding to the width of the keyway as established by the opposed left and right side walls. The left flank 46 has a recessed longitudinal channel portions of which are indicated at 40A and 40B, and the right flank 48 has a right side longitudinal channel, a portion of which is indicated at 40C. In the illustrated embodiment, the key nodes 42A, 42B, and 42C rise above the left channel so as to lie substantially in the same plane as the planer surface of flank 46. Similarly, node 42D rises from the right channel, into the plane of right side flank 48.

Each of the pin bores 26 has an associated pin located therein, but three different types of pins occupy respective bores. Activator pins 50A, 50B and 50C have an overall length substantially equal to the length of the pin bore, and the shape of this type pin interacts with the pin bore such that the pin can freely enter into the keyway in the absence of a confronting node on the key, such as 42A, 42B, and 42C respectively. In particular, the height of the head 56 on the activation pins 50A, 50B, and 50C is less than the height of the counter bore 28, whereby the stem 58 of the activator pin can drop through the pin bore into the keyway, in the absence of a supporting surface at the keyway sidewall. In the presence of such supporting surface, the head portion 56 is flush with the core outer surface. Only one activator pin 50D is provided on the right side of the core, shown with an associated key node 42D. The significance of the activator pins will be discussed below in greater detail.

Preferably adjacent to the back end 16 of the core, a pair of opposed blocking pins 52A, 52B are provided, each having an overall length that is greater than the length of the pin bores, such that when the head of the blocking pin is seated within the respective counter bore, the head is flush with the core outer surface and the pin stem 58 enters into the keyway. In particular, the nose portion 60 of the stem extends into the channel 40B of a properly coded key. It can be appreciated that if the leading portion of a key is not channeled, the key cannot pass beyond the blocking pins and therefore cannot fully insert into the keyway.

Filler pins 54A and 54B, are shown on the left side of the core. Like the blocking pins, the heads on the filler pins are preferably shaped to fill the counter bore while remaining flush with the outer surface of the core, but unlike in the blocking pins, the stem of the filler pin is shortened such that the overall length of the filler pin is no greater than the overall length of the pin bore.

It should thus be understood that, according to the invention, a programmable core installation kit can be provided comprising a core having a plurality of pin bores penetrating from the core surface to the keyway, and a plurality of at least the activator pins and filler pins, such that the installer can locate one or more activator pins in any of the pin bores, and one or more filler pins in any of the remaining bores, to thereby define a code to be provided in the respective flank or flanks of an authorized key. Preferably at least three bores are provided on at least one side of the core, but as a practical matter, four or more pin bores provided on each side of the core offers sufficient variations to thwart all but the most sophisticated attempts at gaining unauthorized entry. Preferably, five pin bores on either side of the core are fitted with a pattern of activator pins and filler pins, whereas a sixth pin bore on each side, closest to the back end of the core, is fitted with a blocking pin. Although not likely to be utilized in practice, the invention includes the extreme cases of programming with all pin bores having activator pins or all pin bores having filler pins, or the pin bores being provided on only one side of the core.

The security effect of the activator pins will be described with respect to FIGS. 4 and 5, which represents a cross section through a cylinder lock system 62 taken through line 4—4 of FIG. 3. To enhance further understanding, it should be understood that FIG. 3 is a section view taken through line 3—3 of FIG. 4. The shell 64 according to the invention has a plurality of tumbler bores 68 located in the same planes as the center lines of the pin bores shown in FIG. 3. Each tumbler bore 68 includes a tumbler 70 with associated spring or the like 72 which biases the tumbler toward the programmed core 44.

For convenience in understanding the further description contained herein, it should be understood that the shell has a longitudinal bore 66 in which the programmed core 44 is closely surrounded such that the core can rotate within the shell bore when a properly coded key is fully inserted into the keyway. The key upper and lower edges 36, 38 are aligned vertically when the core and keyway are in the neutral position, i.e., the keyway top and bottom are at the zero and 180 degree positions, respectively, relative to the axis when viewed from the keyway entry. Thus, the tumbler bore 68 and associated tumbler 70 are at the zero degree angle, the right side pin bores and pin 50D extend along a 90 degree ray from the axis, and the left side pin bore and associated pin 50B extend along a 270 degree ray from the axis. In the plane illustrated in FIG. 4, the core outer surface at the zero degree position contacts the tumbler 70 at the shear line 74, permitting relative rotation. Such rotation resulting from a one-quarter turn clockwise (90 degree rotation clockwise) is illustrated in FIG. 5.

Figure 5:
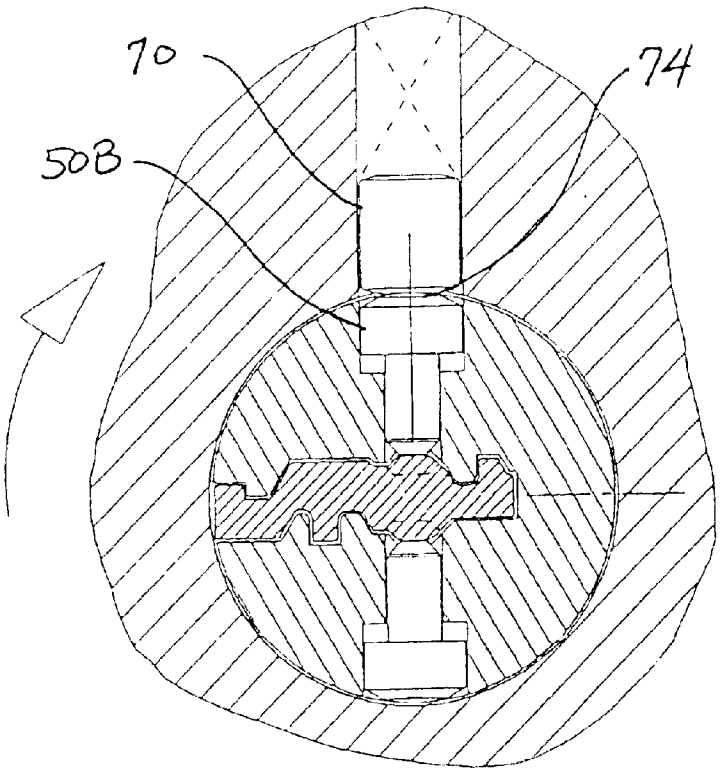
FIG. 5 is a view similar to FIG. 4, upon rotation of the key and core, 90 degrees clockwise.
Figure 4:
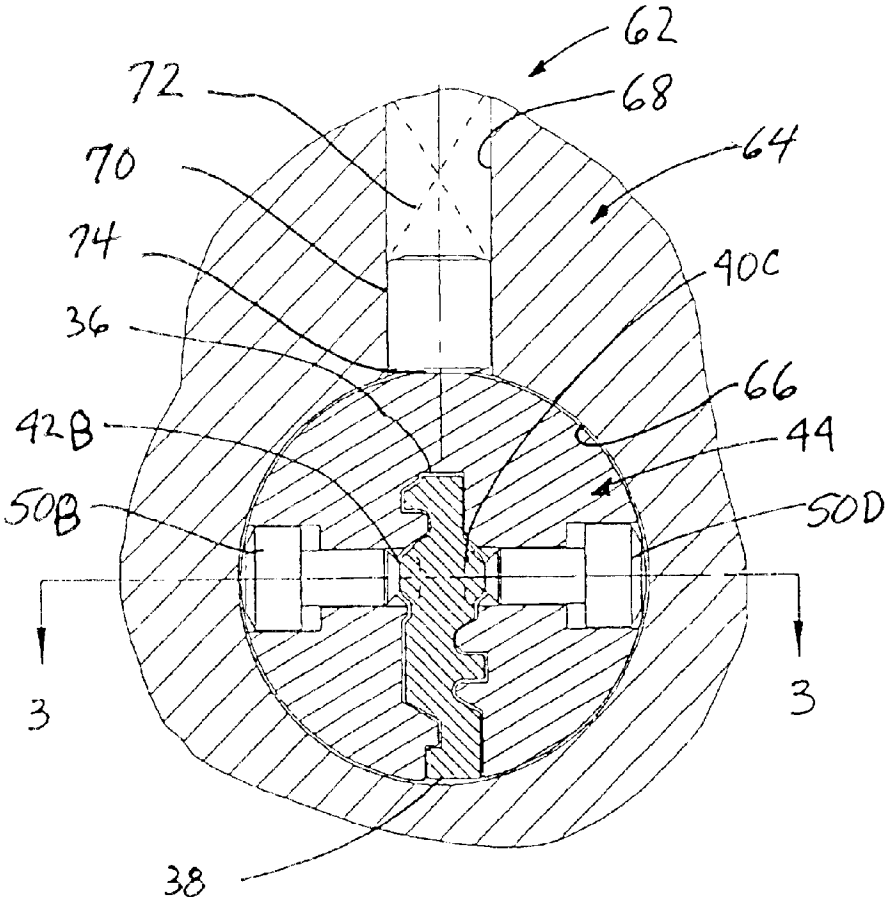
FIG. 4 is a cross sectional view of the programmed core with authorized key as part of a cylinder lock system, taken along the line 4—4 of FIG. 3, in the plane of two activation pins.

It can be appreciated that the head of activator pin 50B remains at the outer surface of the core both at the neural position of the core shown in FIG. 4, and the rotated position of the core shown in FIG. 5, thereby preserving the rotational clearance at shear line 74. Notwithstanding the effect of gravity on pin 50B when it is at the zero degree position shown in FIG. 5, the node 42B on the key supports the pin 50B at the surface of the core, preventing the tumbler 70 from dropping and blocking the shear line. In this particular embodiment, another activator pin 50D is at the 90 degree position in FIG. 4, supported by node 40C, thereby maintaining pin 50D in a position that will not permit blockage of the shear line if the key were rotated 90 degrees counter clock wise from the neutral position in FIG. 4. It can further be appreciated that the conditions shown in FIGS. 4 and 5, whereby the core turns freely within the shell, are applicable to the other node positions shown in FIG. 3.

Figure 6:
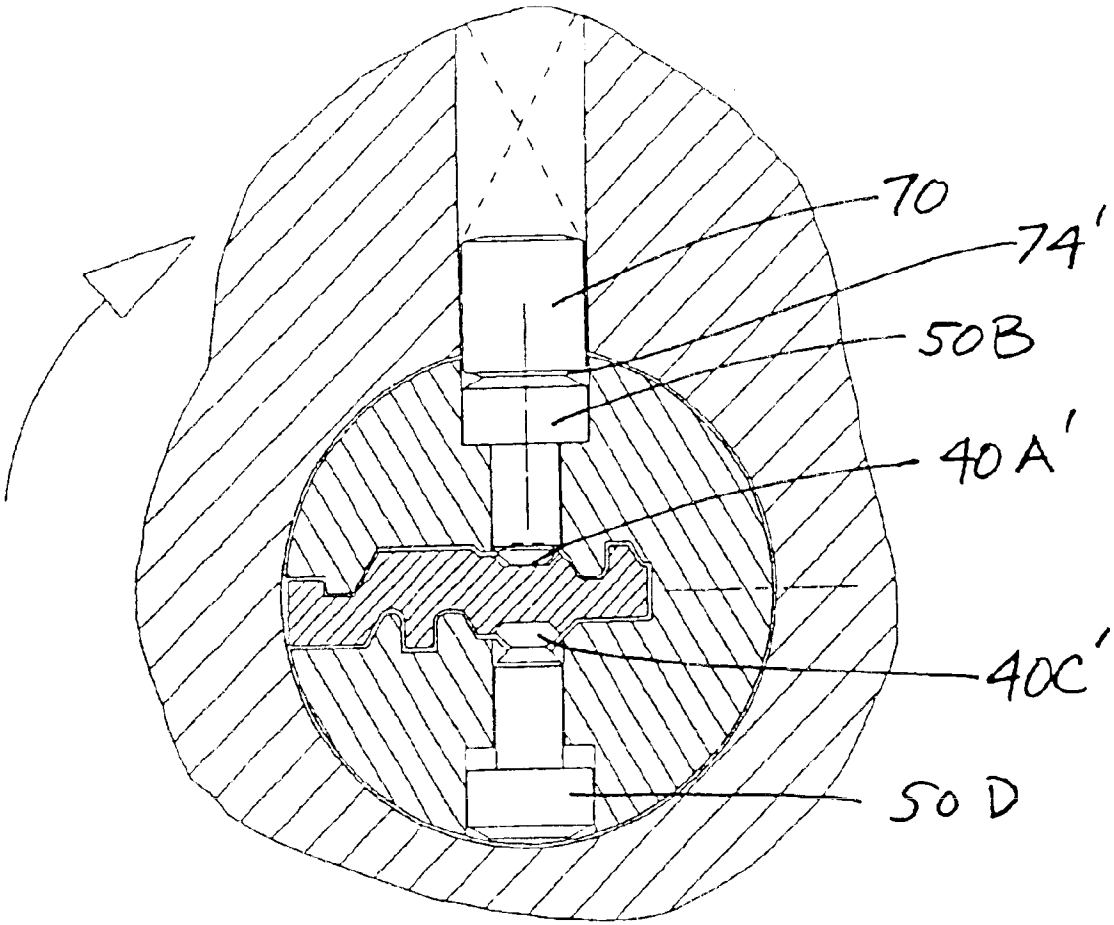
FIG. 6 is a cross sectional view similar to FIG. 5, but with an unauthorized key, resulting in blockage of the shear line between the core and shell.

FIG. 6 shows the consequence of a key that, although fully insertable in the keyway (because the bitting at the top edge has been accurately copied), cannot properly operate the lock because the activator pin 50B dropped under the influence of the tumbler 70 into channel portions 40A' of the key, i.e., at the location where an authorized key has node 40A. The tumbler 70 blocks the shear line, preventing further clock wise or counter clock wise rotation of the core. A similar outcome would result if the key were rotated counter clock wise from the neutral position, due to the interaction of pin 50D with channel portion 40C'.

Figure 8:
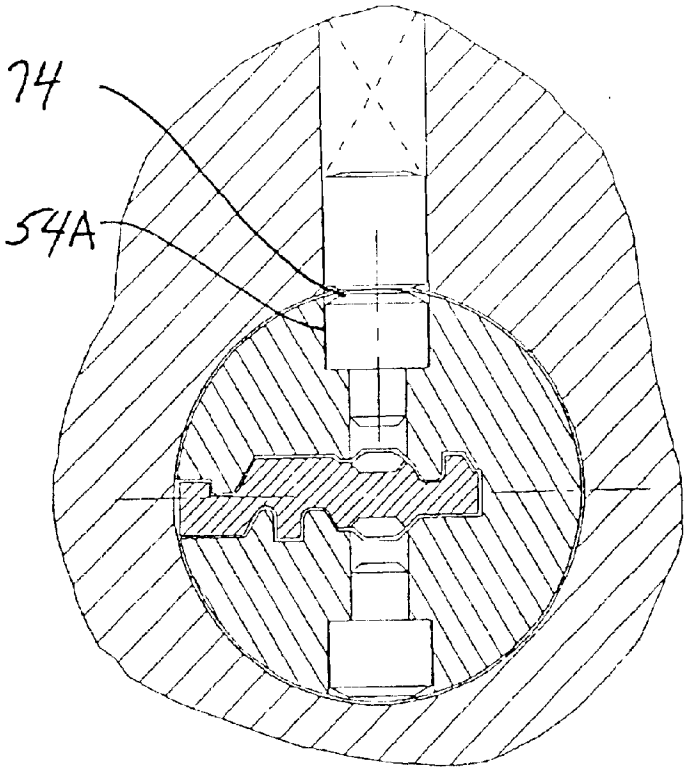
FIG. 8 is a view similar to FIG. 7, but with the key and core rotated 90 degree clockwise, showing no effect on the clear shear line.
Figure 7:
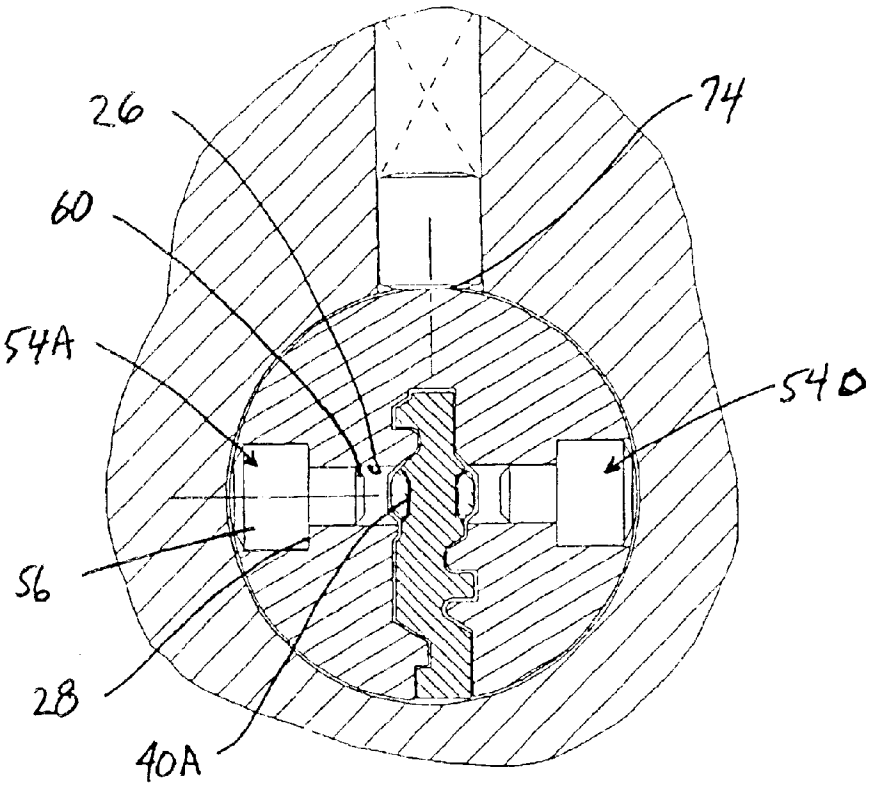
FIG. 7 is a cross sectional view of a cylinder lock system according to the invention, taken through line 7—7 of FIG. 2, in the plane of two filler pins.

FIGS. 7 and 8 show the cooperation of the key and filler pins, such as 54A aligned with channel portions 40A. The nose 60 of pin 54A is not influenced by the key, whether or not a channel 40A or unauthorized node is present. Inasmuch as the head 56 fully occupies the counter bore portion 28, when the key is rotated 90 degree clock wise as shown in FIG. 8, the head portion of pin 54A remains at the core outer surface, holding up the opposed tumbler and maintaining clearance at the shear line 74. A similar filler pin is shown at 54D, opposite pin 54A. In essence, the filler pins prevent locking of the core relative to the shell in the non activated areas of the key.

Figure 10:
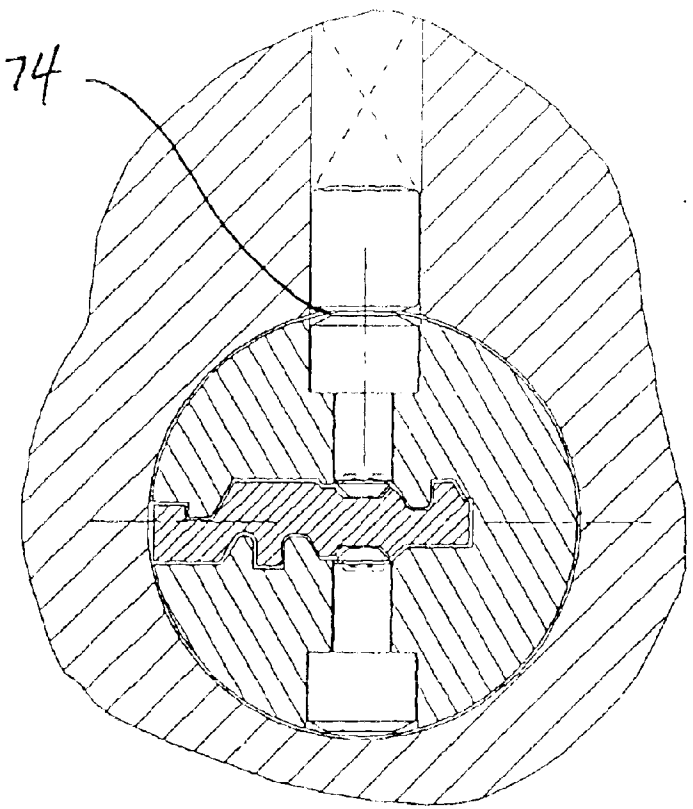
FIG. 10 is a cross sectional view similar to FIG. 9, with the key and core rotated 90 degree clockwise, showing that the clear shear line is maintained with a properly coded key.
Figure 9:
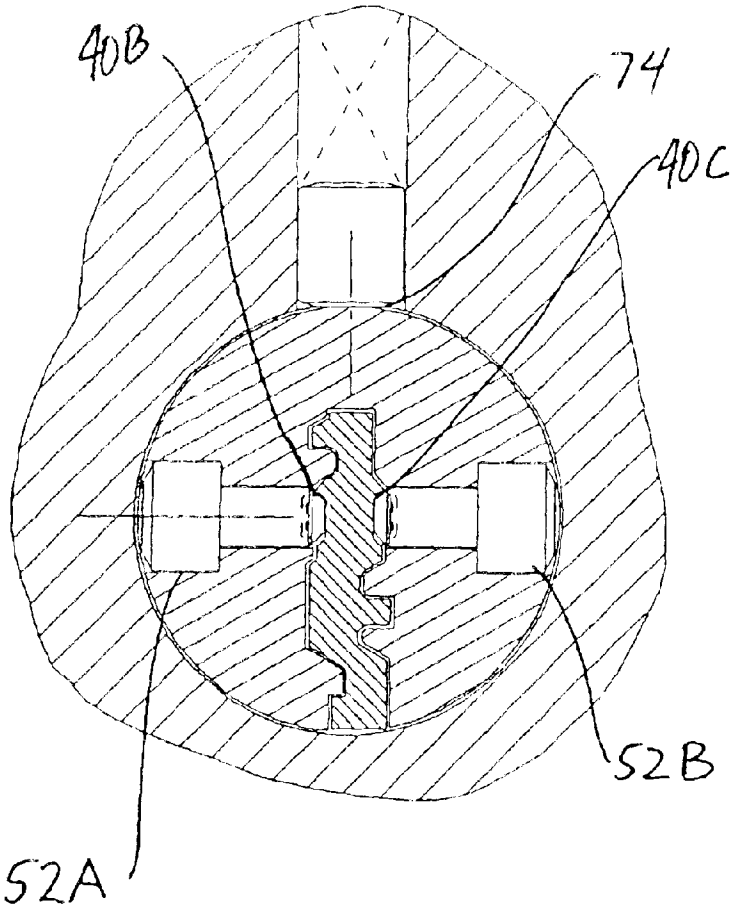
FIG. 9 is a cross section view through a cylinder lock system according to the invention, taken along line 9—9 of FIG. 2, showing blocking pins mating with channels in the key.

FIGS. 9 and 10 show the operation of the blocking pins 52A, 52B, whereby the key may pass via channel portions 40B and 40C. The shape and length of these pins maintains shear line clearance upon rotation.

It should be understood that variations to the illustrated embodiment can be made without departing from the spirit and scope of the claims. For example, the pin bores can be situated at acute angles (other than 90 and/or 270 degrees) relative to the neutral plane of the assembly or the insertion plane of the keyway, so long as the associated pins can interact with a channel and associated node in the flank of a proper key. Such acute angles and the 90 and 270 degree angles can be referred to collectively as "intermediate" angles relative to the zero and 180 degree positions.

What is claimed is:

1. A programmable cylinder lock comprising:

a substantially cylindrical core having front and back ends and a keyway having a key entry at the core front end and extending along the core longitudinal axis toward a core back end, the keyway having a top wall and an opposed open bottom and opposed left and right sidewalls shaped to closely receive a key blade having opposed top and bottom edges and opposed left and right flanks;

a substantially cylindrical shell having a longitudinal bore closely coaxially surrounding the outer surface of the core, wherein the core has a neutral position within the shell such that the keyway top and bottom are at 0 and 180 degree positions, respectively, relative to the axis when viewed from the keyway entry and the core can rotate within the shell bore when a properly coded key is fully inserted in the keyway;

a plurality of tumbler bores located in the shell and penetrating the shell bore at a 0 degree angle relative to the neutral position of the core;

a respective plurality of tumblers located in the tumbler bores and biased toward the shell bore so as to contact the core;

a plurality of pin bores extending a uniform distance from the outer surface of the core to penetration of at least one keyway sidewall at an intermediate angle to the axis;

an activator pin in at least one of the pin bores, said activator pin having a length substantially equal to said uniform distance and a shape for interacting with the pin bore such that the pin can freely enter into the keyway; and a filler pin in at least one of the pin bores, said filler pin having a length no greater than said uniform distance and a shape for interacting with the pin bore such that the pin cannot enter into the keyway.

2. The programmable cylinder lock of claim 1, wherein at least three bores are provided on at least one side of the core.

3. The programmable cylinder lock of claim 1, wherein said plurality of pin bores and pins comprises:

a plurality of left side pin bores extending a uniform distance from the outer surface of the core to penetration of the keyway left sidewall, at a first intermediate angle to the axis, and a plurality of right side pin bores extending a uniform distance from the outer surface of the core to penetration of the keyway right sidewall, at a second intermediate angle to the axis;

an activator pin in at least one of a left side pin bore or a right side pin bore, said activator pin having a length substantially equal to said uniform distance and a shape for interacting with the pin bore such that the pin can freely enter into the keyway; and a filler pin in at least one left side pin bore or at least one right side pin bore, said filler pin having a length no greater than said uniform distance and a shape for interacting with the pin bore such that the pin cannot enter into the keyway.

4. The programmable cylinder lock of claim 3, wherein the first and second intermediate angles are 270 and 90 degrees.

5. The programmable cylinder lock of claim 3, wherein at least four bores are provided on each side of the core.

6. The programmable cylinder lock of claim 5, wherein at least six bores are provided on each side of the core.

7. The programmable cylinder lock of claim 6, wherein each of five of the at least six bores on each side of the core contains an activator pin or a filler pin and one more bore, closest to the back of the core, contains a blocking pin.

8. A programmable core for a cylinder lock comprising:

a substantially cylindrical core having an outer surface, front and back ends and a keyway having a key entry at the core front end and extending along the core longitudinal axis toward a core back end, the keyway having a top wall and an opposed open bottom and opposed left and right sidewalls shaped to closely receive a key blade having opposed top and bottom edges and opposed left and right flanks, such that the keyway top and bottom are at 0 and 180 degree positions, respectively, relative to the axis when viewed from the keyway entry; and said outer surface having at least three left side pin bores extending a uniform distance from the outer surface of the core to penetration of the keyway left sidewall, at a first intermediate angle to the axis, and at least three right side pin bores extending a uniform distance from the outer surface of the core to penetration of the keyway right sidewall, at a second intermediate angle to the axis.

9. The programmable core for a cylinder lock of claim 8, wherein the first and second intermediate angles are 270 and 90 degrees.

10. The programmable core for a cylinder lock of claim 8, wherein at least six bores are provided on each side of the core.

11. A programmable core kit for a cylinder lock comprising:

a substantially cylindrical core having an outer surface, front and back ends and a keyway having a key entry at the core front end and extending along the core longitudinal axis toward a core back end, the keyway having a top wall and an opposed open bottom and opposed left and right sidewalls shaped to closely receive a key blade having opposed top and bottom edges and opposed left and right flanks, such that the keyway top and bottom are at 0 and 180 degree positions, respectively, relative to the axis when viewed from the keyway entry;

said outer surface having at least three left side pine bores extending a uniform distance from the outer surface of the core to penetration of the keyway left sidewall, at a first intermediate angle to the axis, and at least three right side pin bores extending a uniform distance from the outer surface of the core to penetration of the keyway right sidewall, at a second intermediate angle to the axis;

a plurality of activator pins insertable into any of said pin bores, each having a head, a stem, and an overall length substantially equal to said uniform distance, for interacting with the pin bore such that the stem can freely enter into the keyway with the head recessed from the core outer surface; and a plurality of filler pins insertable into any of said pin bores, each having a head, a stem, and an overall length no greater than said uniform distance, for interacting with the pin bore such that the head is substantially flush with the core outer surface and the stem cannot enter into the keyway.

12. The programmable core kit for a cylinder lock of claim 11, wherein at least six bores are provided on each side of the core.

13. The programmable core kit for a cylinder lock of claim 11, wherein the first and second intermediate angles are 270 and 90 degrees.

14. The programmable core kit of claim 11, including a plurality of blocking pins insertable into any of said pin bores, each having a head, a stem, and an overall length that is greater than said uniform distance, for interacting with the pin bore such that the head is substantially flush with the core outer surface and the stem enters into the keyway.

15. The programmable core kit for a cylinder lock of claim 14, wherein the first and second intermediate angles are 270 and 90 degrees.

16. A cylinder lock system comprising:

a substantially cylindrical core having front and back ends and a keyway having a key entry at the core front end and extending along the core longitudinal axis toward a core back end, the keyway having a top wall and an opposed open bottom and opposed left and right sidewalls shaped to closely receive a key blade having opposed top and bottom edges and opposed left and right flanks;

a substantially cylindrical shell having a longitudinal bore closely coaxially surrounding the outer surface of core, wherein the core has a neutral position within the shell such that the keyway top and bottom are at 0 and 180 degree positions, respectively, relative to the axis when viewed from the keyway entry and the core can rotate within the shell bore when a properly coded key is fully inserted in the keyway;

a plurality of tumbler bores located in the shell and penetrating the shell bore at a 0 degree angle relative to the neutral position of the core;

a respective plurality of tumblers located in the tumbler bores and biased toward the shell bore so as to contact the core;

a plurality of left side pin bores extending a uniform distance from the outer surface of the core to penetration of the keyway left sidewall, at a first intermediate angle to the axis, and a plurality of right side pin bores extending a uniform distance from the outer surface of the core to penetration of the keyway right sidewall, at a second intermediate angle to the axis;

an activator pin in at least one of a left side pin bore or a right side pin bore, said activator pin having a length substantially equal to said uniform distance and a shape for interacting with the pin bore such that the pin can freely enter into the keyway;

a filler pin in at least one of a left side pin bore or at least one right side pin bore, said filler pin having a length no greater than said uniform distance and a shape for interacting with the pin bore such that the pin cannot enter into the keyway; and a key insertable into the keyway, said key having a blade with top and bottom edges and left and right flanks, each of the flanks having a longitudinal channel spaced from the keyway sidewall and alignable with said plurality of left side pin bores and right side pin bores, respectively, at least one of the channels having a raised node alignable with and closely approaching a pin bore.

17. The cylinder lock system of claim 16, wherein at least four bores are provided on each side of the core.

18. The cylinder lock system of claim 17, wherein at least six bores are provided on each side of the core.

19. The cylinder lock system of claim 18, wherein each of five of the at least six bores on each side of the core contains an activator pin or a filler pin and one more bore, closest to the back of the core, contains a blocking pin.

* * * * *